US008226000B1

(12) United States Patent
Hunley

(10) Patent No.: US 8,226,000 B1
(45) Date of Patent: Jul. 24, 2012

(54) POINTER RANGE DESIGNATOR

(76) Inventor: Keith Hunley, Santa Fe, TN (US)

( * ) Notice: Subject to any disclaimer, the term of this patent is extended or adjusted under 35 U.S.C. 154(b) by 19 days.

(21) Appl. No.: 13/007,613

(22) Filed: Jan. 15, 2011

(51) Int. Cl.
*G06G 7/80* (2006.01)

(52) U.S. Cl. ..... 235/404; 40/474

(58) Field of Classification Search ..... 235/404; 40/474

See application file for complete search history.

(56) References Cited

U.S. PATENT DOCUMENTS

| | | | | | |
|---|---|---|---|---|---|
| 1,832,947 | A * | 11/1931 | Sullivan et al. | ..... | 40/503 |
| 3,634,961 | A * | 1/1972 | Nawalaniec | ..... | 40/598 |
| 5,464,219 | A * | 11/1995 | Bradford et al. | ..... | 473/150 |
| 5,626,525 | A * | 5/1997 | Tolley et al. | ..... | 473/150 |
| 5,769,731 | A * | 6/1998 | Reimer | ..... | 473/150 |
| 6,729,536 | B2 * | 5/2004 | Davignon, II | ..... | 235/78 G |
| 7,278,216 | B2 | 10/2007 | Grace | | |
| 2003/0189697 | A1 | 10/2003 | Cullison | | |
| 2003/0233757 | A1 * | 12/2003 | Nordberg | ..... | 33/265 |

* cited by examiner

*Primary Examiner* — Daniel Hess

(57) ABSTRACT

Embodiments of the invention include methods and apparatuses relating to pointer range designators. In an embodiment, a marking on a pointer and a rotation of the pointer may designate the distance from a location to an object.

20 Claims, 7 Drawing Sheets

POINTER RANGE DESIGNATOR

BACKGROUND

1. Field

The subject matter disclosed herein generally relates to pointers for range designation, and more particularly, pointer range designators that may communicate range information to one shooting a weapon, particularly bow shooters using sights with sight indicia.

2. Information

Range finding can be a daunting task. Range finding is critical when shooting because the ballistics of a projectile may greatly affect the projectile's flight path. More specifically, the force of gravity causes fired projectiles to experience an increasing vertical drop during their flight path.

To compensate for a projectile's vertical drop, shooters sight in a weapon at desired distances and adjust the weapon's aim when shooting. Sighting in requires adjusting a weapon's sight so that projectiles fired from the weapon hit the point that the sight is aimed at. When sighting in, a shooter usually knows the distance to their target. Weapons may only have one sight and are therefore sighted to only one distance, although multiple sight devices are also used, especially in conjunction with archery bows. Furthermore, some multiple sight devices have sight indicia, which are usually colored markers on each sight that allow easy differentiation between the various sights.

When using a weapon that has been sighted in, the shooter may compare the distance to a target with the distance their weapon is sighted in to. Then, using their knowledge of a projectile's ballistics, a shooter will adjust their aim vertically to compensate for a projectile's drop. This adjustment is especially important when a target is at a great distance, but it is also vital when bow hunting at close range because bow arrows may drop more drastically and rapidly than firearm cartridges.

There are three main methods a shooter may use to determine the distance to a target. From the shooting location, a shooter may use visual aides, mechanical tools, or electronic devices to determine the distance to a target. This method is problematic because it requires a shooter to measure distance right before firing, which is typically a time when a shot must be rapidly fired and the shooter should remain as concealed and quiet as possible. Conversely, a shooter may simply estimate the distance to a target. Estimating distance is a difficult skill to master, though, and it has been shown in military field tests that the average person estimates range with a 30% margin of error. Therefore, this method is inherently problematic, and hunters often place inaccurate shots because they incorrectly estimate the distance to their target.

A shooter may also measure the distance to other objects, potentially marking the objects with an indicator of this distance. The shooter will then approximate a target's distance based on the target's location relative to the objects that are at known distances. Traditional methods employed to indicate distance are problematic because memorizing the distance to objects is difficult and markings of distance may be nonadjustable, visually obtrusive, and difficult to read from a distance.

BRIEF DESCRIPTION OF THE DRAWINGS

The following figures of embodiments are examples, rather than limitations, in which references may indicate similar elements and in which.

DETAILED DESCRIPTION OF THE INVENTION

Figure 1:
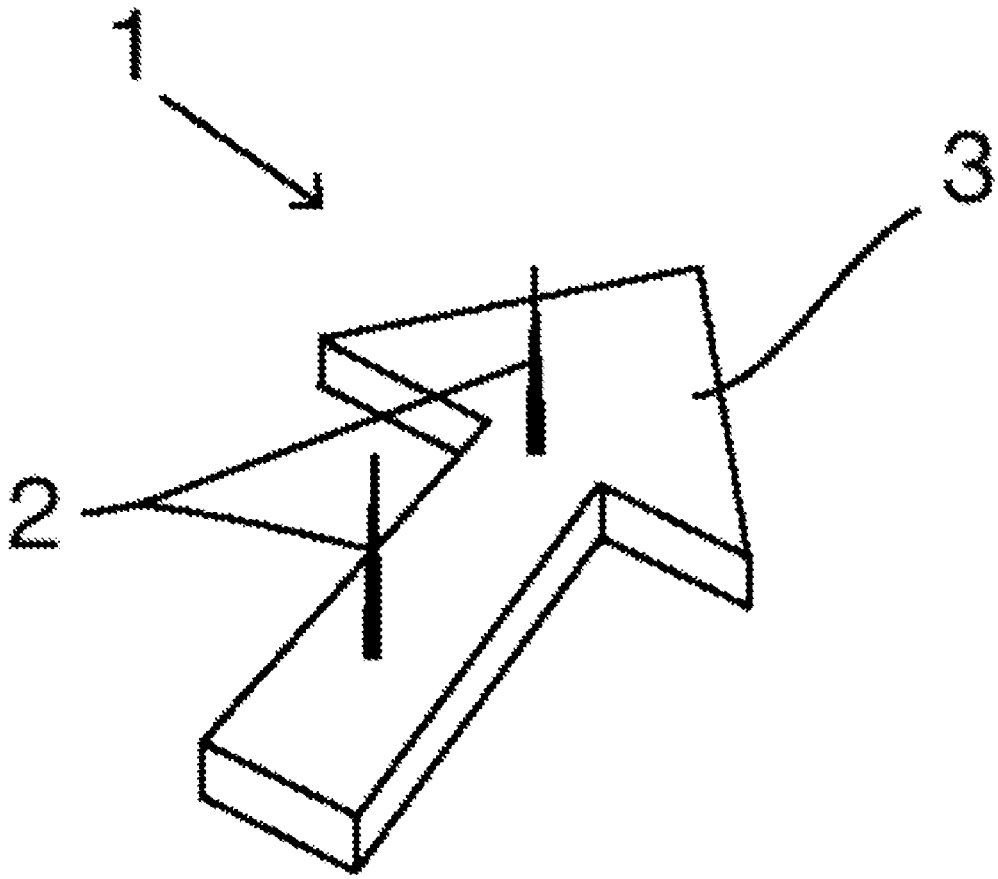
FIG. 1 illustrates an embodiment of a pointer range designator apparatus.

The following description discloses embodiments intended to serve as explanations rather than necessary configurations. Those skilled in the art will appreciate that the embodiments may be practiced with all or only part of the elements described. Although certain embodiments are described, components of the various embodiments may be combined in any suitable manner. To best describe the embodiments, certain structures and components well known to those skilled in the art may be lacking in this description. The embodiments in the figures are possible configurations, are not necessarily drawn to scale, and are meant to serve as non-limiting illustrations.

Embodiments for a pointer apparatus to designate range are described. Pointer range designators are intended, without limitation, to provide a visual marker of the distance to an object for a shooter. Pointer range designators may be mounted to an object and a shooter may estimate the distance to a target by comparing the target's location relative to the marked objects. This method is advantageous because a shooter may perform such estimations quickly while remaining very silent and still compared to a shooter who must physically measure the distance to a target at a moments notice. The described method is usually more accurate than merely attempting to estimate the distance to an object. These advantages can make the difference between properly shooting prey and missing, or even worse, inaccurately hitting prey.

Elements of the various embodiments of a pointer range designator help shooters mark distance without the shortcomings of previous methods. A pointer range designator itself may be marked so that it corresponds to a distance. This marking may come in any form. In an example, the marking may consist of a color. Furthermore, the user may rotate the pointer range designator to fine-tune the distance that the pointer range designator represents. A user may determine what distances the pointer range designator's marking and rotational position represent, but commonly a marking will represent a distance of a multiple of ten and the degree to which the pointer range designator is rotated will represent a distance of 0-10 units.

This design is advantageous because a particular pointer range designator may be marked and rotated to represent any desired distance. This makes the embodiment infinitely adjustable, whereas traditional signs with numbers are not as freely adjustable. The relatively plain design also makes the embodiments visually non-obtrusive, particularly because the pointer range designator need only be visible, rather than having to be legible, from a particular distance. This is a desirable characteristic for those who wish to keep a natural setting as pristine as possible.

Embodiments of the invention may also have the ability to be read quickly and accurately. A user need not concern themselves with reading signs with numbers or actually measuring distance, but only needs to quickly identify a pointer range designator's marking and rotational position. Furthermore, embodiments that utilize colors as markings may be matched up to the colored sight indicia that are used in some weapon sights, and particularly many hunting bow sights. With these colors matched together, a shooter's guesswork is virtually eliminated since they only need to determine the pointer range designator's color, aim with the corresponding sight, and then make slight vertical adjustments to their aim based on the pointer range designator's rotational position and the target's distance relative to the pointer range designator.

Looking now to FIGS. 1-6, several different embodiments are shown. In FIG. 1 a pointer range designator 1 is shown from the back side. As shown, pointer range designator 1 may include a fastener 2 extending from the back side of an indicator 3. The indicator 3 is shown as an arrow-shaped object, but indicators may be any object that visually points in one direction and that can be rotated. The indicator 3 may be made of any material including, without limitation, metals, woods, polymers, plastics, and resins. Synthetic materials are advantageous for indicators 3 because they may be easily manufactured, for example via blow molding, and are resistant to corrosion and weather. The fastener 2 shown in FIG. 1 comprise two spikes, but fasteners 2 may be any device, object, or substance that allows one to attach the pointer range designator 1 to an object 30. Types of fasteners 2 include spikes, nails, screws, straps, ropes, hook and loop fasteners, adhesives, and the like.

Figure 2:
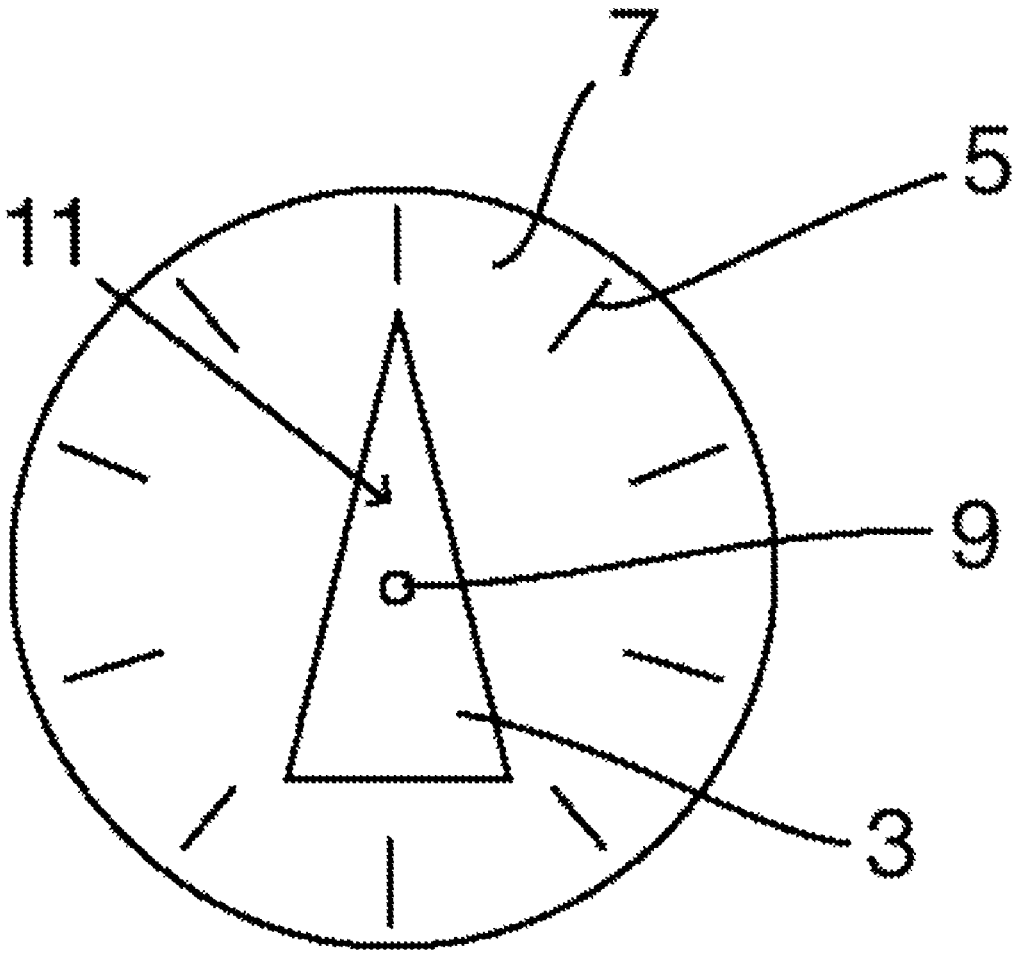
FIG. 2 illustrates a front view of an embodiment of a pointer range designator with a backing.

Referencing FIG. 2, a frontal view of an embodiment is illustrated. The embodiment has an indicator 3, a marking 11 on the front side of the indicator 3, which may represent a designated distance, and a backing 7. The backing 7 may provide an easier background upon which to view the indicator 3, especially if the indicator 3 and backing 7 colors contrast. A backing 7 may be made from any appropriate material, including those appropriate for indicators 3. The backing 7 may be flat and may extend over an area greater than that covered by an indicator's 3 complete circular rotation. Furthermore, the backing 7 may comprise tick marks 5 around its perimeter that may represent single units of distance. There may be any number of tick marks 5, but ten are illustrated in FIG. 2.

Continuing with FIG. 2, a pivot point 9 rotatably attaches the backing 7 to the indicator 3. Such a pivot point 9 provides an attachment point that allows an indicator 3 to rotate freely about the backing 7. Pivot points 9 may not be included in all embodiments with backings 7. Pivot points 9 may be designed so as to lock in particular positions. Also, FIG. 2 depicts a marking 11 in the form of a color, but markings 11 may come in various forms, including numbers, symbols, light emitting devices, fiber optics, and the like.

Figure 3:
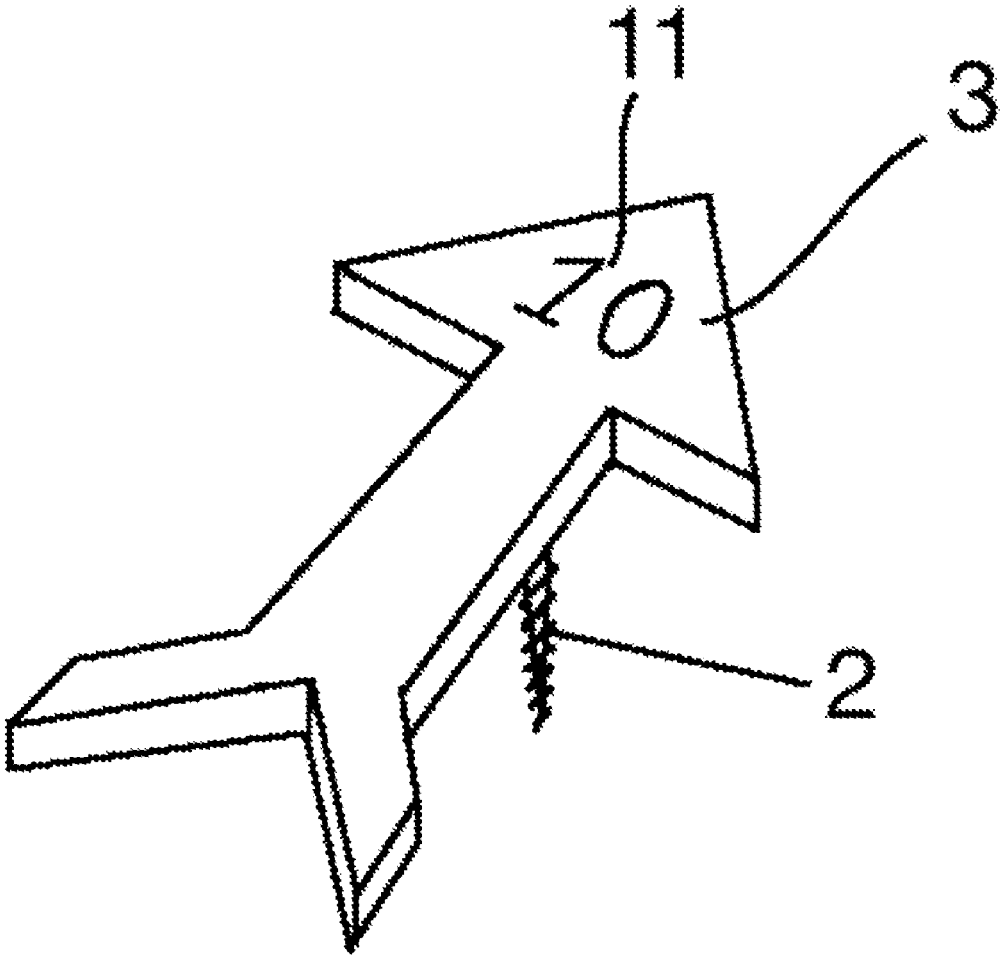
FIG. 3 illustrates an embodiment of a pointer range designator apparatus.

The embodiment depicted in FIG. 3 has an indicator 3, a marking 11, and a fastener 2. Unlike previous embodiments, FIG. 3 illustrates possible differences between embodiments. As shown, an indicator 3 may be arrow shaped and may include any number of tail flaps that may make it easier to determine the direction in which the indicator 3 is pointing. Indicators 3 may be shaped in any manner that makes them appear to point in a direction, such shapes including arrows, triangles, tear drops, needles, and the like. Objects, such as feathers, may be attached to indicators 3 to decorate or make them more visible. Indicators 3 may be any size necessary to make the indicator 3 viewable from a desired distance. A pointer range designators 1 used for distances of 30 to 50 yards may be about 1 to 4 inches wide and about 3 to 12 inches in length.

FIG. 3 also shows that a fastener 2 may be a screw. Fasteners 2 that are screws may be advantageous over single spikes because they may make it more difficult for the indicator 3 to accidentally rotate, for instance if there is a strong wind. Spiked or screwed fasteners 2 may be designed to have more than one screw or spike, thereby inhibiting an indicator 3 from accidentally rotating.

Figure 4:
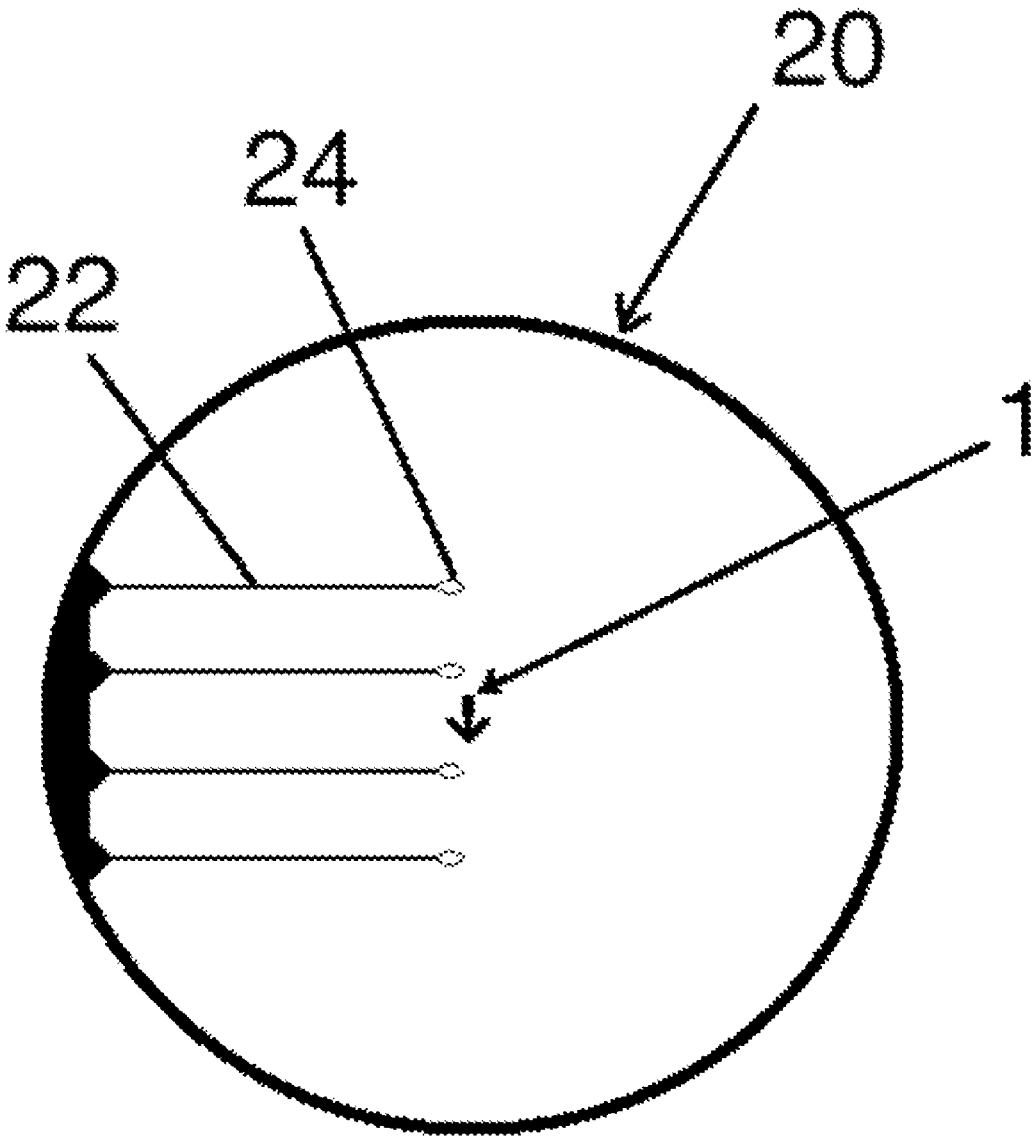
FIG. 4 illustrates an embodiment of a pointer range designator apparatus as seen through a bow sight with sight pins.

FIG. 4 gives a perspective of how a pointer range designator 1 may be used in the field, and illustrates how a pointer range designator 1 may be seen through a particular design of a bow sight 20. The bow sight 20 in FIG. 4 may include sight pins 22 that may extend from the edge of the bow sight 20 to an imaginary vertical centerline of the bow sight 20. The end of the sight pins 22 located in the center of the bow sight 20 may represent potential impact points. A user may sight in so that a projectile hits a specific impact point. The ends of the sight pins 22 may have sight indicia 24, which may be fiber optics or other colored objects. FIG. 4 shows how a user may quickly match the colors of sight indicia 24 and an indicator's 3 marking 11 to quickly determine the proper sight pin 22 to aim with, and then may use a pointer range designator's 1 rotational position to make slight vertical aim corrections.

Figure 5:
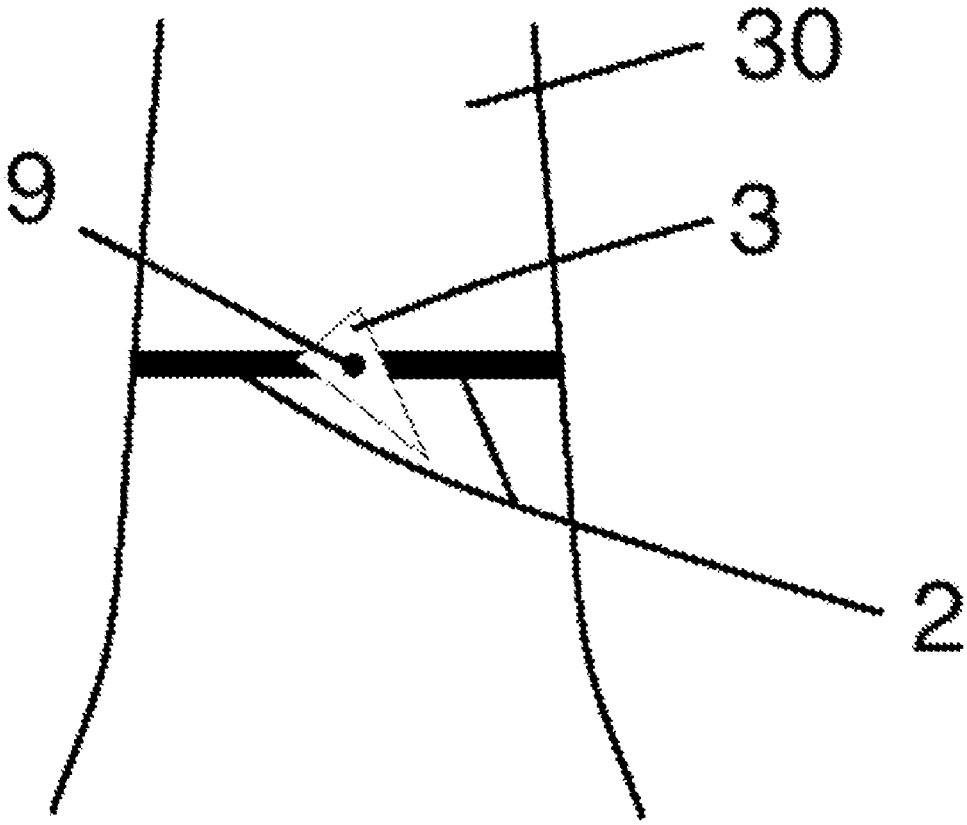
FIG. 5 illustrates an embodiment of a pointer range designator attached to an object.

FIG. 5 shows how an embodiment of an indicator 3 may be attached to an object 30 with a fastener 2. As shown, an indicator 3 may be rotatably attached to the fastener 2 with a rotatable pivot point 9, although pivot points 9 may not be included in all embodiments. These pivot points 9 may be indistinguishable from those included on embodiments with backings 7, and may also have locking mechanisms that hold an indicator 3 in a desired rotational position. Locking mechanisms may be of any design. Such designs may include click-in points to hold multiple positions or tightening mechanism, such as a screw, that can be tightened to hold a desired position. As stated earlier, fasteners 2 may be embodied in any form that allow an indicator 3 to attach to an object 30. A fastener 2 that is a strap, as shown depicted in FIG. 5, may be advantageous because it may damage objects 30 less than other fasteners 2, such as spikes. Straps, ropes, or similar fasteners 2 may quickly mount to objects 30 and may be easily adjusted.

Figure 6:
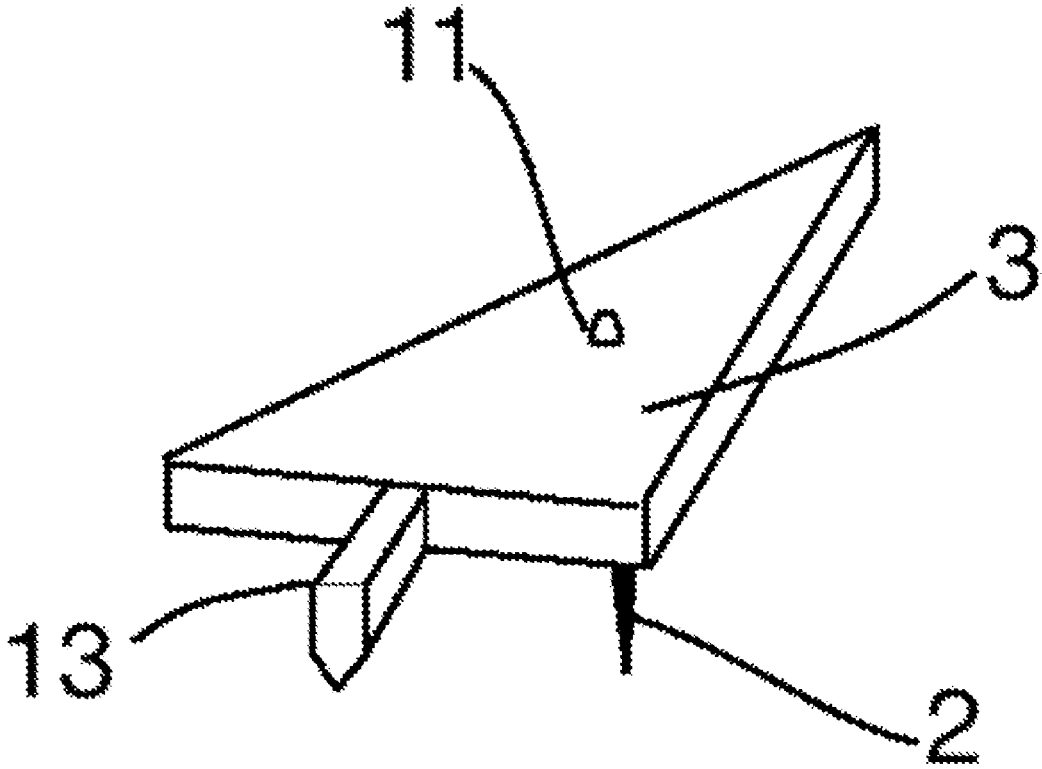
FIG. 6 illustrates an embodiment of a pointer range designator with a lock.

Illustrated in FIG. 6, an embodiment may have an indicator 3, fastener 2, marking 11, and lock 13. As shown, the marking 11 may be a light emitting diode. Markings 11 that are in the forms of light emitting devices, reflective paints, fiber optics, and the like may aid a shooter who uses a pointer range designator 1 in low light conditions.

The lock 13 embodied in FIG. 6 comprises a bar that may extend from an indicator 3 and that may angle toward the back side of the indicator 3. The lock 13 may engage an object 30 when a range designator 1 is mounted to that object 30. This physical engagement of the lock 13 on the object 30 may be such that it may prevent the indicator from freely rotating. Furthermore, the end of the lock 13 may have a spike or sharp point to engage an object 30 with greater ease and with greater holding power. A lock 13 may be adjustable to allow a user to engage and disengage the lock 13 without needing to dismount the indicator 3 from the object 30. Mechanisms such as hinges, tightening screws, and the like may give locks 13 such adjustability. There are many viable lock 13 embodiments that may prevent an indicator 3 from rotating by engaging an object 30 in at least one rotational position. Locks 13 may be used alone or in conjunction with fasteners 2 that likewise may prevent unwanted rotation of a mounted indicator 3.

Figure 7:
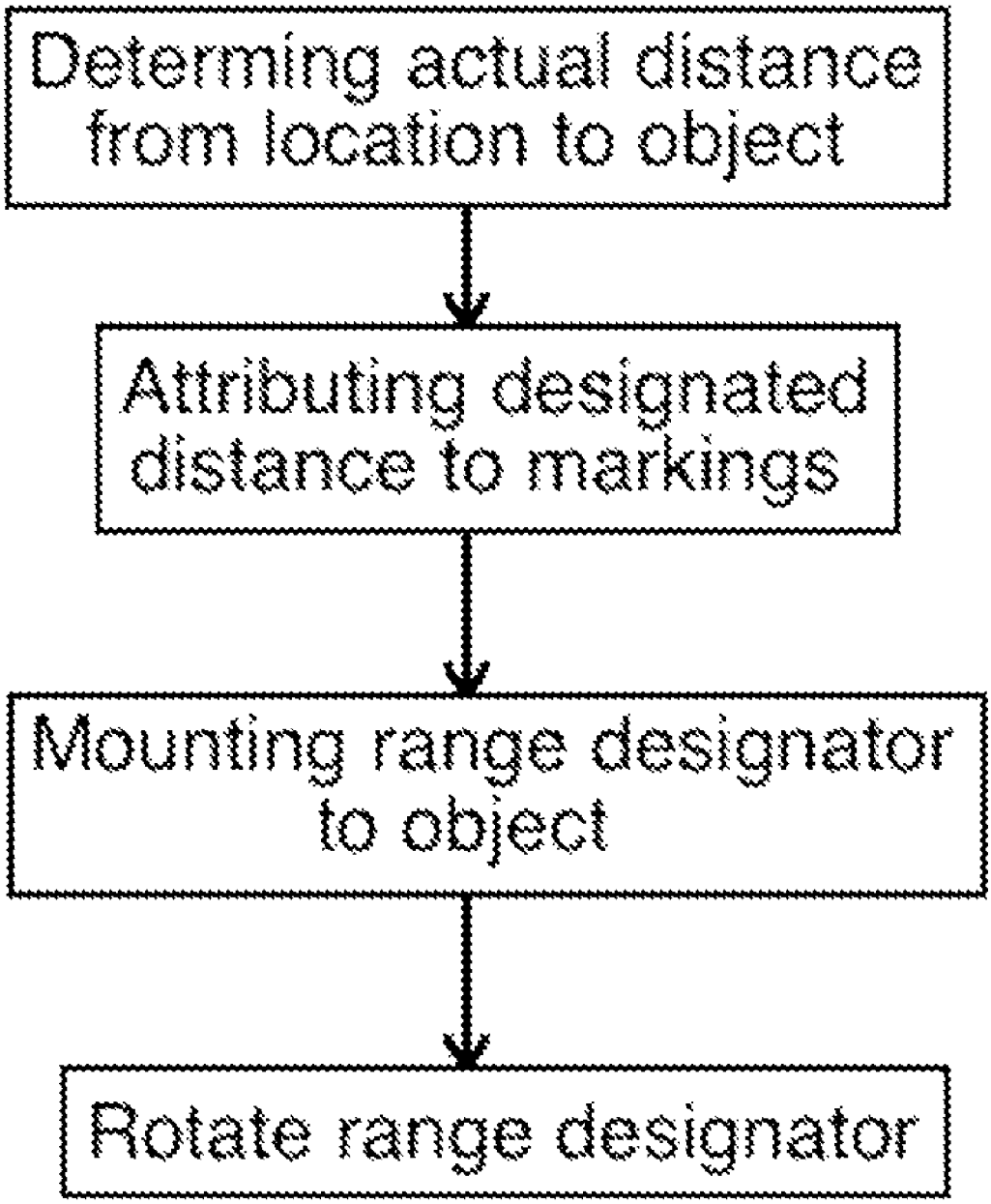
FIG. 7 illustrates a flow chart for utilizing a pointer range designator.

FIG. 7 depicts a flow chart of how a user may use a pointer range designator 1. First, a user may determine an actual distance from a location to an object 30. Next, the user may attribute a designating distance to the marking 11 on a pointer range designator 1. The user may then mount the pointer range designator 1 to an object 30 using the fastener 2. Lastly, the user may rotate the pointer range designator 1 to point in a direction that may correspond to the difference between the actual and designating distances, known as the differential distance. Note that if pointer range designators 1 with non-rotatable fasteners 2 or locks 13 are used, the user may first determine the indicator's 3 appropriate rotational position and then mount the pointer range designator 1 so that the indicator 3 is mounted in that position.

There are infinite methods by which a user may attribute designating distances and differential distances to a pointer range designator 1, but the following methods may be most common or useful to shooters, particularly those within 100 yards of a target. If markings 11 are not numbers, and for instance are colors, a user may attribute a designated distance of a multiple of ten to each different marking 11. Next, a user may mount an indicator 3 with a marking 11 that corresponds to a designated distance nearest to the actual distance measured to the object 30. An indicator's 3 rotation may only represent positive differential distances, in which case one may only mount an indicator 3 with a designated distance that is less than or equal to the actual distance.

A user has various ways in which they may rotate an indicator to indicate the proper differential distance, but the following are possible embodiments. A user may rotate the indicator 3 clockwise or counterclockwise to symbolize, respectively, positive or negative differential distances. A user may determine what differential distance a particular degree of rotation corresponds to. In two embodiments an indicator 3 is rotated in any of ten or twelve positions to symbolize single units of differential distance. Twelve positions may be desirable to those who analogize an indicator's 3 position with the position of an hour hand on a traditional clock. Rather than set increments, rotational positions may be on a continuous scale, making the indicator 3 infinitely adjustable. In another embodiment, a user may combine methods so that, for instance, an indicator 3 in the 12 to 6 o'clock positions represents positive differential distances and 6 to 12 o'clock positions represent negative differential distances.

To illustrate how a pointer range designator 1 may be used, the following example will implement an embodiment of a range pointer designator 1 with colored markings 11 corresponding to designated distances of multiples of ten yards. Differential distances range from 0 to ten yards, and each yard may be symbolized by a 36 degree clockwise rotation of an indicator 3. Hypothetically, consider a target 2 yards further than a pointer range designator 1 whose marking 11 designates a distance of 30 yards and whose indicator is pointed in the 6 o'clock position, representing a differential distance of 5 yards. The user will use this information to determine that the pointer range designator 1 is 35 yards away and that the target is 37 yards away. The shooter may then aim with a sight that corresponds to the designated distance, or 30 yards, and then adjust their aim vertically to account for the extra 7 yards of flight path to the target.

A user of a weapon with colored sight indicia 24 may have the added benefit being able to select and aim with a sight pin 22 that has sight indicia 24 that matches the color of a particular marking 11. Subsequently, the user may compensate their aim vertically accounting for an indicator's 3 rotation and the target's distance from that particular indicator 3.

Having described a particular embodiment of the invention so as to provide an enabling written description of the invention to one of ordinary skill to make, use, and practice the invention, the particular embodiments are only illustrative of the invention as a whole. Those of ordinary skill in the art appreciate the existence of variations, combinations, and equivalents of the specific embodiment herein. The invention should therefore not be limited by the above described embodiment, but should be construed broadly in a manner consistent with the scope of the invention.

What is claimed is:

1. An apparatus for designating distance to an object for ballistics calibration comprising:

an indicator including a back side and a front side, wherein the indicator is configured to rotate to indicate a differential distance;

a fastener extending from the back side of the indicator configured to secure the indicator to the object; and a marking on the front side of the indicator configured to indicate a designated distance.

2. The apparatus of claim 1, wherein the marking comprises a color.

3. The apparatus of claim 1, wherein the marking comprises a light emitting device.

4. The apparatus of claim 1, further comprising:

a backing coupled to the back side of the indicator.

5. The apparatus of claim 4, wherein the backing is rotatably coupled to the indicator.

6. The apparatus of claim 4, further comprising:

a plurality of tick marks arranged circularly about the indicator.

7. The apparatus of claim 1, further comprising:

a lock coupled to the indicator, wherein the lock is configured to engage the object with physical force to prevent the indicator from rotating.

8. The apparatus of claim 1, wherein the fastener comprises a plurality of spikes.

9. The apparatus of claim 1, wherein the fastener comprises a strap.

10. The apparatus of claim 1, wherein the fastener is rotatably coupled to the indicator.

11. An apparatus for indicating distance to an object for ballistics calibration comprising:

a pointer including a viewing side and an attachment side, wherein the pointer is configured to indicate a fractional distance;

at least one spike extending from the attachment side configured to attach the pointer to the object without allowing for rotation of the pointer; and a colored marker on the viewing side configured to indicate a designated distance, wherein the designated distance is less than a measured distance and wherein the fractional distance is the difference between the designated distance and the measured distance.

12. The apparatus of claim 11, further comprising:

a circular panel coupled to the attachment side of the pointer.

13. A method of ballistics calibration, the method comprising:

determining an actual distance from a location to an object;

attributing a designated distance to a marking on a range designator;

mounting the range designator on the object; and rotating the range designator to point in a direction that corresponds to a differential distance, wherein the differential distance is the difference between the actual distance and the designated distance.

14. The method of claim 13, further comprising:

finding a target at a target distance;

locating the range designator nearest to the target;

calculating the actual distance to the range designator by taking the sum of the designated distance and the differential distance indicated by the range designator;

estimating the target distance by comparing the target distance to the actual distance to the range designator;

aiming a weapon at the target with a sight sighted to the designated distance attributed to the range designator; and adjusting the aim of the weapon to account for the difference between the target distance and the designated distance.

15. The method of claim 13, wherein the degree to which the range designator is rotated clockwise indicates an increasingly positive differential distance.

16. The method of claim 13, wherein the degree to which the range designator is rotated counterclockwise indicates an increasingly negative differential distance.

17. The method of claim 13, further comprising sighting in at least one sight of a shooting device to the designated distance.

18. The method of claim 13, further comprising:

using a color as the marking;

utilizing a sight with at least one colored sight indicia; and sighting in the at least one colored sight indicia to the designated distance attributed to the marking of the same color.

19. The method of claim 13, further comprising locking the range designator in a desired rotational position.

20. The method of claim 13, wherein the range designator further comprises:

an indicator including a back side and a front side, wherein the indicator is configured to rotate to indicate a differential distance;

a fastener extending from the back side of the indicator configured to secure the indicator to the object; and a marking on the front side of the indicator configured to indicate a designated distance.

* * * * *